US005438846A

United States Patent [19]

Datta

[11] Patent Number: 5,438,846

[45] Date of Patent: Aug. 8, 1995

[54] HEAT-PUMP WITH SUB-COOLING HEAT EXCHANGER

[76] Inventor: Chander Datta, R.R.#6, Kingston, Ontario, Canada, K7L 4V3

[21] Appl. No.: 246,357

[22] Filed: May 19, 1994

[51] Int. Cl.[6] ..... F25B 27/02

[52] U.S. Cl. ..... 62/238.7; 62/324.1

[58] Field of Search ..... 62/238.6, 238.7, 324.1

[56] References Cited

U.S. PATENT DOCUMENTS

| | | | |
|---|---|---|---|
| 4,257,239 | 3/1981 | Partin et al. | 62/238.7 |
| 4,383,419 | 5/1983 | Bottum | 62/238.6 |
| 4,399,664 | 8/1983 | Derosier | 62/238.6 X |
| 4,409,796 | 10/1983 | Fisher | 62/238.6 X |
| 4,528,822 | 7/1985 | Glamm | 62/238.7 |
| 4,766,734 | 8/1988 | Dudley | 62/238.7 X |
| 4,993,483 | 2/1991 | Harris | 62/238.7 X |
| 5,269,153 | 12/1993 | Cawley | 62/238.7 X |

*Primary Examiner*—William E. Tapolcal

*Attorney, Agent, or Firm*—Daniel E. Kramer

[57] ABSTRACT

A reversible compression type refrigeration system is provided having a heating mode and a cooling mode. The system includes a liquid receiver and a liquid refrigerant line for feeding refrigerant to an expansion device. A main service heat exchanger is provided for absorbing heat from a fluid stream in the heating mode and for rejecting waste heat to the fluid stream during the cooling mode. A main process heat exchanger is provided for cooling or heating a load. A sub-cooling heat exchanger is positioned in the liquid refrigerant line between the receiver and the expansion device and connected in heat exchange relation with the fluid stream entering the main service heat exchanger, whereby the liquid refrigerant flowing to the expansion device is sub-cooled both during the heating and the cooling modes and the fluid stream flowing to the main service heat exchanger is warmed.

6 Claims, 3 Drawing Sheets

HEAT-PUMP WITH SUB-COOLING HEAT EXCHANGER

FIELD OF THE INVENTION

The present invention relates primarily to improvements in reversible compression type refrigeration systems or heat pumps which operate in heating and cooling modes. The invention is further directed to means for increasing liquid refrigerant subcooling at the inlet of the expansion device in both modes, where the means also improves evaporator performance in one mode.

Related Art

Applicants patent 5,212,965, issued May 25, 1993, discloses the use of a subcooling heat exchanger in the inlet fluid stream of an evaporator.

BACKGROUND OF THE INVENTION

Compression type refrigeration systems employ an evaporator which is supplied with low pressure refrigerant liquid. The low pressure refrigerant boils away or evaporates when supplied with heat from a medium to be cooled. The most common media which are cooled by such systems are streams of air, and streams of water or aqueous brines. The refrigerant vapor emitted from the evaporator is delivered by a pipe called a suction line to a mechanism which simultaneously acts as a vacuum pump to draw vapor from the evaporator and as a condensing device to restore the refrigerant vapor to a liquid condition so it can be reused in the evaporating part of the refrigerating cycle. The evacuating and condensing mechanism is called a condensing unit. The condensing unit has two major components. The evacuating device is most frequently a mechanical compressor driven by an electric motor. The compressor draws refrigerant vapor from the evaporator and compresses it and delivers it via a pipe to a condenser. The condenser condenses the hot refrigerant vapor to a refrigerant liquid by bringing it into heat exchange with a coolant. The most commonly employed coolants are air, employed in air-cooled condensers, water, employed in water cooled condensers and a mixture of air and water employed in so-called evaporative condensers.

The refrigerant liquid is then generally transmitted from the condenser to a holding tank called a receiver, where it is stored until needed by the evaporator. The refrigerant liquid when stored in the receiver generally has a temperature which is a few degrees cooler than the temperature at which it condensed called the saturated condensing temperature. The number of degrees which the refrigerant liquid is cooler than the saturated condensing temperature is called the subcooling or the degrees of subcooling. When the refrigerant liquid leaves the receiver it is in the form of liquid without any bubbles. However, if the subcooling is reduced to zero either by warming the refrigerant liquid those few degrees of subcooling or by lowering the pressure on the refrigerant liquid, bubbles, often called flash-gas, will form in the refrigerant liquid.

When the refrigerant liquid flows toward the evaporator from the receiver in a pipe called the liquid line, it is at high pressure. In order for the refrigerant liquid to evaporate and cool the fluid needing refrigeration, its pressure must be reduced. This pressure reduction is secured by passing the high pressure refrigerant liquid through a flow restrictor, also called an expansion device. Flow restrictors come in many forms. One is in the form of a length of tubing having a very small bore called a capillary tube. It is the form of restrictor most often used in domestic refrigerators, freezers and room air-conditioners. Another is in the form of a fixed orifice, frequently used in automotive air-conditioners. The form of restrictor most frequently employed in larger commercial or industrial refrigeration systems of the type toward which the present invention is primarily directed is a valve which senses both the pressure in the evaporator and the temperature at the refrigerant vapor outlet of the evaporator. This dual sensing valve is called a thermal expansion valve or TXV for short.

TXV's work best when the refrigerant liquid fed to them is free of bubbles. Such bubble-free liquid is also called clear liquid or "solid" liquid. Used in this sense, "solid" liquid is not frozen liquid but is simply refrigerant liquid which is free of bubbles.

Since the refrigerant liquid which is stored in the liquid receiver has only a few degrees of subcooling, it is not uncommon for the refrigerant liquid to reach the TXV inlet in a bubbling state. Expansion valves receiving bubbling refrigerant liquid tend to act erratically. Erratic TXV performance has a detrimental effect on evaporator capacity and therefore on overall system capacity.

Refrigeration systems frequently have their condensers and receivers located at ground level and their TXV and evaporators positioned at a much higher level. During the refrigeration cycle the liquid refrigerant flowing to the TXV and evaporator is exposed to severe loss of sub-cooling and therefore high likelihood of bubbling by the pressure loss caused by the flow of the liquid to a higher elevation and by the friction loss from the long run of piping and from the pressure-drop producing, and therefore sub-cooling reducing, valves and fittings which are positioned in the liquid line between the receiver outlet and the TXV.

In order to control these flash gas producing factors many costly design stratagems are employed. Among these are increasing the diameter of the liquid line, raising the condenser and receiver to a level near that of the TXV, oversizing all the pressure-drop producing flow elements or providing a suction-liquid heat exchanger. In some cases, it is so difficult to maintain a bubble-free supply of refrigerant liquid to the TXV that the TXV is deliberately oversized to allow a semblance of reasonable, though significantly degraded, performance with bubbles entering the TXV.

To overcome the tendency of refrigeration systems to deliver bubbling refrigerant liquid to their TXV so-called suction-liquid heat exchangers are frequently employed. These heat exchangers are installed in the system suction line. The piping is arranged to pass the vapor emitted from the suction outlet of the evaporator in heat exchange relation to the high pressure refrigerant liquid flowing from the receiver to the TXV. This heat exchange cools the refrigerant liquid and either condenses bubbles if any have formed in the liquid, or increases the degree of subcooling of the refrigerant liquid, thereby reducing the propensity of the refrigerant liquid to form bubbles. Unfortunately, suction-liquid neat exchangers have a series of disadvantages.

First, they introduce pressure drop in the suction line. Suction line pressure drop has the effect of reducing compressor capacity and therefore system capacity.

Second, they warm the suction vapor returning to the compressor from the evaporator with exactly the same number of heat units (Btus, calories etc) that are extracted from the refrigerant liquid flowing through the exchanger. The warmed suction vapor has dual negative effects: that of reducing the compressor capacity by presenting to the compressor warmed and therefor less dense refrigerant vapor to compress; and that of causing the high pressure vapor discharged by the compressor to be hotter than necessary. The higher the compressor discharge temperature, the thinner the compressor lubricant and the more likely the lubricant will suffer some thermolytic degradation resulting in shortened compressor life.

Third, suction-liquid heat exchangers fail to work when most needed. For example, when the TXV is in the mode of receiving a mixture of liquid and vapor, its flow capacity is so reduced that the evaporator cannot be fully flooded. Therefore the refrigerant vapor leaving the evaporator is warm and relatively ineffective to substantially cool the liquid/vapor mixture flowing toward the TXV.

Fourth, the suction-liquid heat exchanger cannot reduce the temperature of the refrigerant liquid flowing to the TXV to near the temperature of the fluid entering the evaporator, though the greatest improvement in evaporator capacity and stability of TXV performance is achieved with coldest liquid entering the TXV.

Finally, the suction-liquid heat exchanger is costly both to manufacture and to install.

It is against this background that I have conceived the present invention applicable to reversible compression type refrigeration systems, commonly known as heat pumps, which avoids all the problems described above. My improved heat pump system provides liquid subcooling without any suction line pressure drop.

My improved heat pump system does not contribute to any warming of the suction vapor enroute from the evaporator to the compressor.

My improved heat pump system works to sub-cool refrigerant liquid flowing to the TXV even when the evaporator is not fully flooded with refrigerant liquid.

My improved heat pump system cools the refrigerant liquid flowing to the TXV to a temperature close to the temperature of the fluid entering the one of the two main heat exchangers.

In addition, compared to a conventional heat pump system, my improved heat pump system has the following further advantages:

* It provides assurance of bubble-free refrigerant liquid at the TXV inlet.
* It increases the heat pump system capacity.
* In heating mode, where outdoor air is the heat source, it reduces the amount of surface participating in frost accumulation, thereby reducing both the time and energy required for a complete defrost.
* In cooling mode with high sensible heat loads, ie. computer room applications, it provides increased sensible heat ratio of the evaporator.
* It causes the evaporator to operate with higher entering temperatures of the fluid-to-be-cooled, thereby enhancing system coefficient of performance (COP).
* It is adaptable to both finned coil heat exchangers for heating and cooling air and to shell or plate type heat exchangers for heating and cooling liquid. Though shell type heat exchangers are referred to, any heat exchanger capable of performing the required heat exchange is intended.

Although all the above factors apply in non-reversible refrigeration systems, the same factors are especially important in reversible refrigeration systems of the type most commonly employed both to heat a residence in winter and to cool it in summer.

It is the objective of the present invention to provide means for offsetting losses of sub-cooling and providing the other advantages and avoiding the disadvantages of the prior arrangements.

SUMMARY OF THE INVENTION

Briefly stated the present invention comprises an improved heat pump. The heat pump includes a supplementary heat exchanger positioned in and subject to the cooling effect of the fluid inlet stream to the outdoor coil. The heat exchanger is connected to convey and cool liquid refrigerant enroute from the condenser to the expansion device.

BRIEF DESCRIPTION OF THE DRAWINGS

The forgoing summary, as well as the following description of preferred embodiments of the present invention, will be better understood when read in connection with the appended drawings. For the purpose of illustrating the invention, there is shown in the drawings embodiments which are presently preferred. It must be understood, however, that the invention is not limited to the specific instrumentalities or the precise arrangements of the disclosed elements. In the drawings.

DETAILED DESCRIPTION OF THE INVENTION

Figure 1:
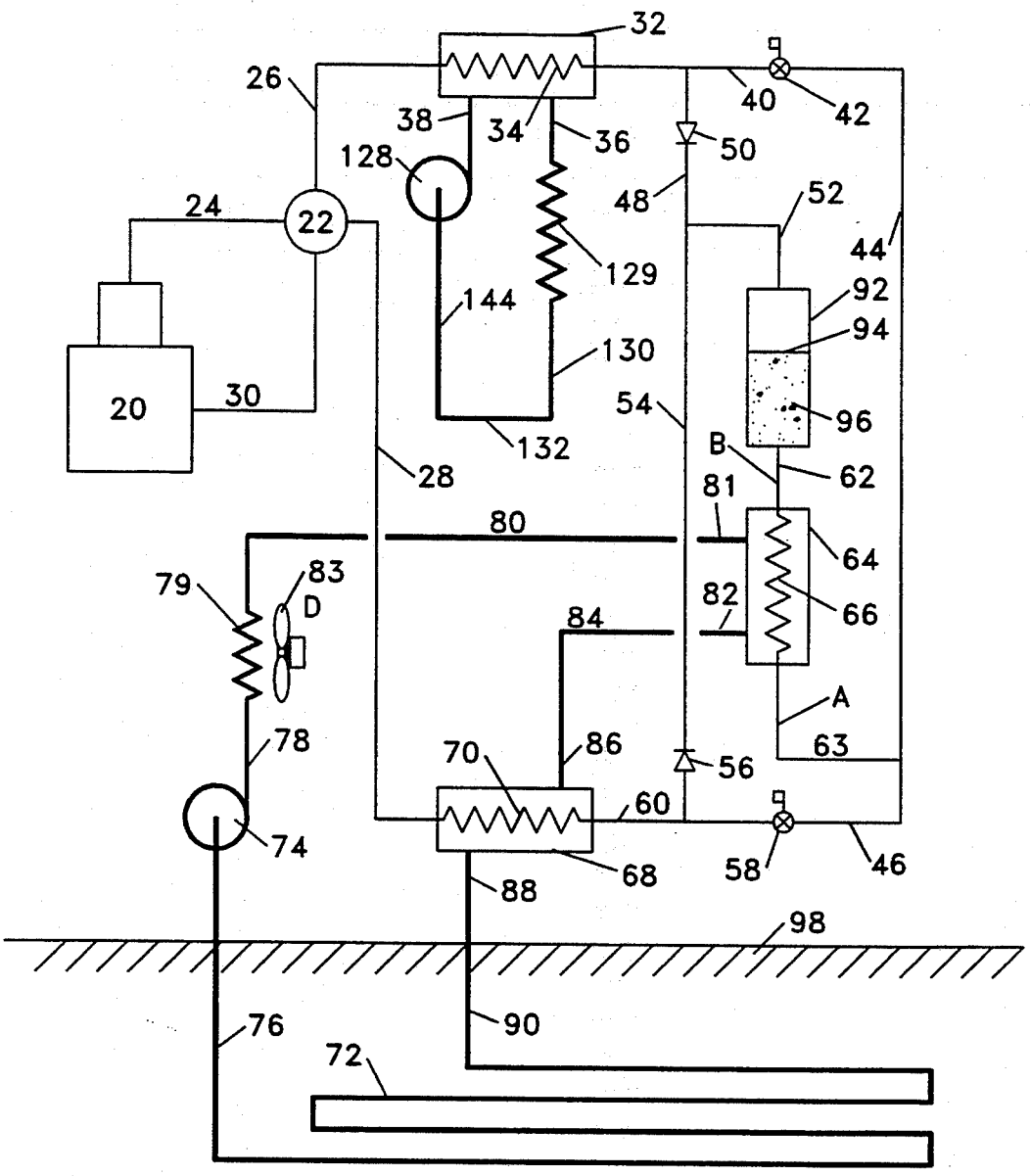
FIG. 1 is a schematic piping diagram of a heat pump system utilizing the improvement of the present invention and employing liquid as the external heat transfer medium.

Referring now to the drawings, wherein like references are employed to indicate like elements, there is shown in FIG. 1 a schematic piping diagram and major element representation of a reversible compression type refrigeration system of the type which is withdraws heat from earth and discharges that heat to an environment where the heat is required for human comfort or processing of products. In order to provide consistent terminology for reference to the system components, the part of the system which uses a common resource such as the earth or the outside ocean of air for supplying heat or for accepting rejected heat will be called the service side. The part of the system which performs desired cooling or heating will be called the process side. The function of the desired heating or cooling, performed by the process side, may be to improve or modify an occupied environment, such as air-conditioning a space, or it may be to facilitate some process, such as heating domestic hot water or supplying heat to a chemical reactor.

Since the system of FIG. 1 operates in two modes, a heating mode and a cooling mode, description of refrigerant flow and of the operation and effectiveness of the system and of the improvement will be provided for each mode.

During the heating mode, heat is withdrawn from earth 98 by buried pipes 72 and transferred to heat exchange element 70 by way of a liquid such as water or a solution of ethylene glycol and water which is circulated through pipes 72 and other connected pipes and heat exchanges to be described, by pump 74. Heat exchange element 70 is one of two main heat exchangers 70 and 34 employed in the system. Hereafter any such liquid, pure or mixed which participates in the heat transfer process without change of phase will be identified as 'brine'. Main heat exchanger 70 absorbs heat from the earth warmed brine by its function as evaporator in the heat pump refrigeration cycle.

Referring now to the refrigeration cycles in the figures, there is provided compressor 20 which draws refrigerant vapor from suction line 30 at a lower pressure and discharges the refrigerant vapor via discharge line 24 at a higher pressure. The discharge vapor flows through 4-way reversing valve 22 where it is directed, in the heating mode, to main heat exchanger 34, which functions as a condenser. The heat of condensation of the condensing refrigerant is absorbed by brine circulated by brine pump 128 in a recirculating loop. Shell 32 provides flow means for the circulating brine in heat transfer contact with heat exchanger 34. The liquid resulting from the condensation process flows through process side check valve 50 and into receiver 92 where it resides in a liquid pool 96.

The liquid 96 then flows from receiver 92 to heat exchanger 66 via liquid line conduit 62. The hot liquid is cooled (and subcooled) through heat exchange with brine which has traversed earth coil 72 and service side brine pump 74. The brine in cooling and sub-cooling the liquid refrigerant is itself warmed. The sub-cooled liquid refrigerant now enters service side thermal expansion valve 58 (TXV) by way of flow through conduits 63 and 46. The pressure of the liquid refrigerant is reduced in the TXV to a level at which it will evaporate to cool the warmed brine flowing from sub-cooling heat exchanger 66 to and through service side heat exchanger 70, which acts as an evaporator in this heating mode. Vapor resulting from evaporation of the liquid refrigerant in heat exchanger 70 now flows to the compressor 20 via suction line 28, 4-way valve 22 and suction line 30 where the cycle is repeated.

The heat absorbed by service heat exchange element 70 is rejected at a higher temperature by process heat exchanger 34 to the brine flowing through shell 32. The heat from the warmed brine is used to heat a space or warm a product by flow through heat exchanger 129 which is positioned to transfer heat from the warmed brine to the space or product.

During the cooling mode, heat is withdrawn from a space or product by heat exchange element 34, thereby cooling it. The heat absorbed by heat exchange element 34 is discharged at a higher temperature level to the brine, by heat exchange element 70, and subsequently absorbed by the relatively cooler earth 98, through which the brine is circulated by service side pump 74 and ground coil 72.

Refrigerant liquid 96 residing in receiver 92 is conveyed by liquid line 62 to subcooling heat-exchanger 66. In one mode of operation the refrigerant liquid reaches the subcooling heat exchanger 30 in bubble-free condition but having only about 6° F. (3.3° C.) subcooling. The subcooling heat exchanger 66, through its heat exchange interaction with entering brine stream arriving from brine pump 74, further cools the refrigerant liquid, thereby sharply increasing its subcooling and placing the refrigerant liquid in a perfect condition to be controlled by TXV 58, even if TXV 58 is elevated or a long distance from receiver 92 and even if pressure drop producing elements such as valve or driers are positioned in the liquid flow stream to TXV 58. Under some adverse conditions, the refrigerant liquid reaches subcooling heat exchanger having zero sub-cooling and having many bubbles, that is, having refrigerant vapor or flash gas mixed with the refrigerant liquid. Under these adverse conditions of operation, subcooling heat exchanger 66 first acts to completely condense all the vapor or flash gas. When condensation of the flash gas is complete, the subcooling heat exchanger 66 proceeds to subcool the now bubble-free stream of refrigerant liquid, again providing a perfect liquid condition for control by TXV 58.

The reversible refrigerating system now operates with a higher efficiency and greater capacity than when subcooling heat exchanger 66 is absent. The reasons for this unexpected improvement in performance of the reversible refrigeration system are: first, that the TXV performs in a completely stable manner having a stream of totally bubble free, sub-cooled liquid fed to its inlet; second, that the evaporating heat exchanger 70 has a substantially higher capacity When its TXV 58 is fed a stream of highly sub-cooled refrigerant liquid. Cold and highly subcooled refrigerant liquid flowing through the TXV generates much less flash gas in the TXV than warm or hot refrigerant liquid flowing through the TXV. With much less flash gas formed initially in the TXV, there is a higher percentage of refrigerant liquid in the evaporator tubes thereby providing better wetting of the inside of the evaporating surfaces by the refrigerant liquid, and therefore higher heat transfer coefficients, resulting in improved evaporator performance. Third, the subcooling heat exchanger 66, positioned in the entering brine stream to the evaporator heat exchanger 66, warms the brine entering the heat exchanger 66. This warmer brine serves to raise the temperature differential between the refrigerant liquid evaporating inside heat exchanger 66 and the brine stream traversing it. When the evaporator heat exchanger 70 operates with a greater temperature difference, its capacity is greater and therefore the system suction pressure is greater resulting in improved compressor and therefore system capacity.

In the cooling mode, 4-way reversing valve 22 directs hot refrigerant vapor discharged by compressor 20 to service heat exchanger 70 by way of conduit 28. There the heat of condensation is removed from the hot refrigerant vapor and refrigerant liquid is formed by the flow in heat exchange relation of brine circulated by pump 74. The brine, warmed by having absorbed the heat of condensation of the condensing refrigerant, now circulates through ground coil 72 where it is cooled by transferring its heat to earth 98.

The high pressure refrigerant liquid leaving heat exchanger-condenser 70 now flows to receiver 92 by way of conduit 60, check valve 56 and conduits 54 and 52. Though conduit 48 is at high pressure and conduit 40 at low pressure, check valve 50 prevents unwanted flow from 48 to 40. The liquid refrigerant flows from receiver 92 through liquid line 62, then to process side TXV 42 by way of sub-cooling heat exchanger 66 and liquid lines 63 and 44. In sub-cooling heat exchanger 66 the hot liquid refrigerant is cooled and sub-cooled by earth-cooled brine delivered to it by service side pump 74 and brine conduit 78. The brine, having been slightly warmed by its traverse in heat exchange with subcooling heat exchanger 66, then flows through service side heat exchanger-condenser 70 to provide the condensing heat removal function as described above.

Figure 2:
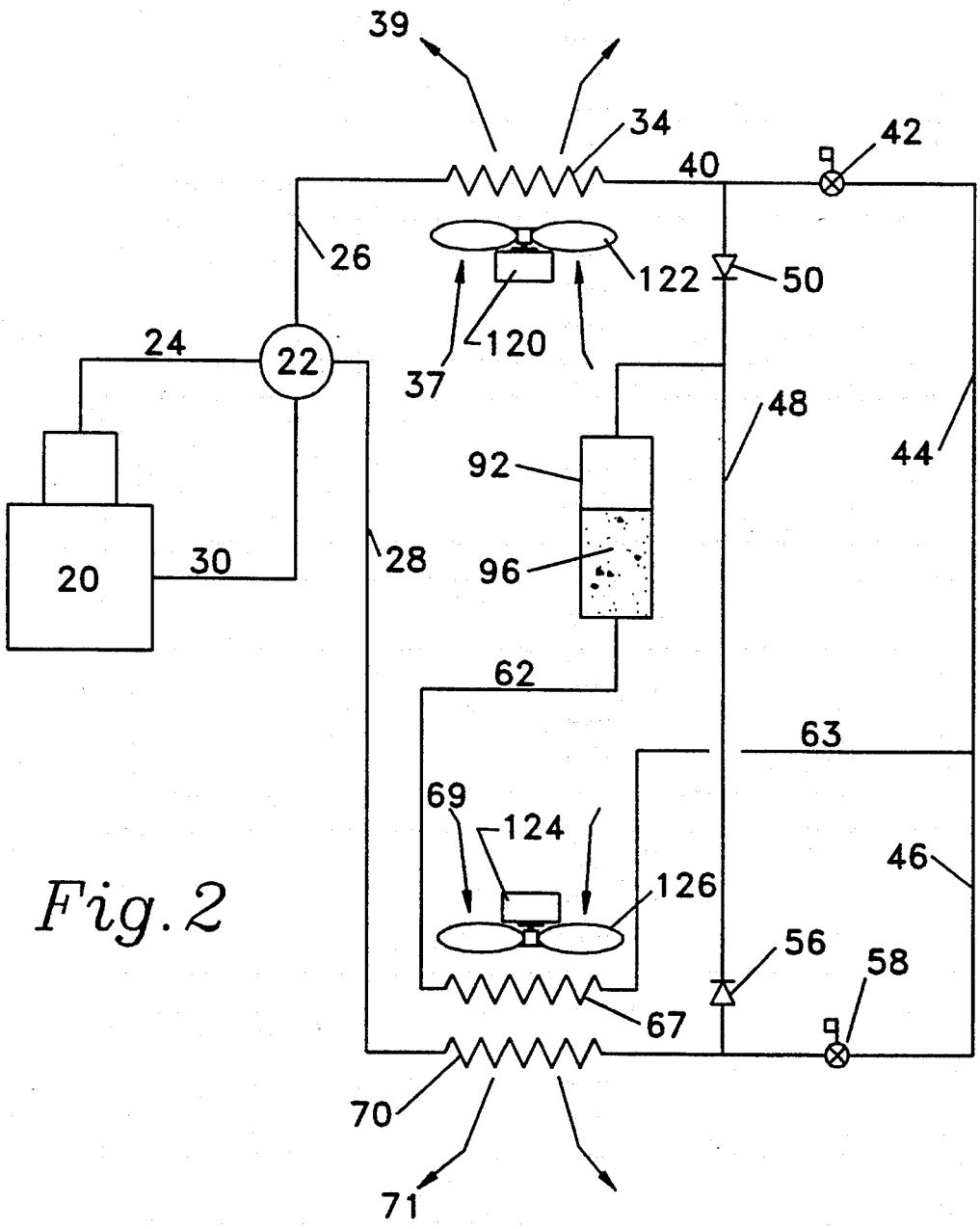
FIG. 2 is a schematic representation of a heat pump system similar to that of FIG. 1 which employs air as the external heat transfer medium.

In FIG. 2 the refrigeration cycle is substantially as described in connection with FIG. 1 except that the fluids being heated and cooled are air. In FIG. 2, fan motor 120 drives fan 122 which establishes an entering air stream 37 and a leaving air stream 39 over heat exchanger 34. During the heating mode refrigerant condensation occurs in heat exchanger 34 and the entering air stream 37 is warmed, thereby providing the desired heating effect. During the cooling mode, refrigerant evaporation occurs in heat exchanger 34, thereby providing the desired cooling effect on air stream 37.

On the service side, sub-cooling heat exchanger 66 has been moved to a position on the inlet air side of service side heat exchanger 70. In this physical position the thermal relationship between the sub-cooling heat exchanger 66 and the service side heat exchanger 70 is the same as the relationship between these heat exchangers in FIG. 1. That is, the fluid performing the heat supplying function during the heating mode and the heat absorbing function during the cooling mode, both first traverse the sub-cooling heat exchanger 66, then the service side heat exchanger 70. During the heating mode the entering air 69 provides the desired sub-cooling of the liquid 96 flowing from receiver 92 through sub-cooling heat exchanger 66 enroute to process side TXV 42. The slightly warmed air them performs its condensing function by providing a sink for the heat of condensation of the refrigerant condensing in service side heat exchanger 70.

During the heating mode, the inlet air stream 69 first provides the function of sub-cooling the refrigerant 96 flowing from receiver 92 to service side TXV 58, them having been warmed by performing its sub-cooling function, provides a warmer source of heat for the service side heat exchanger 70, now functioning as an evaporator, thereby improving the temperature differential between the evaporating refrigerant and the traversing air stream.

Referring again to FIG. 1, in another embodiment of the present invention, the air to refrigerant heat exchanger 67 and fan-motor 124, 126 of figure two are installed in liquid line 63 at a position at the outlet of heat exchanger 66 identified by the letter 'A' or alternately at the positioned in liquid line 62 at the inlet of heat exchanger 66 identified by the letter 'B'. In these embodiments of the invention, the supplemental cooling effect of the ambient air is employed to augment the sub-cooling effect of sub-cooling heat exchanger 66.

Figure 3:
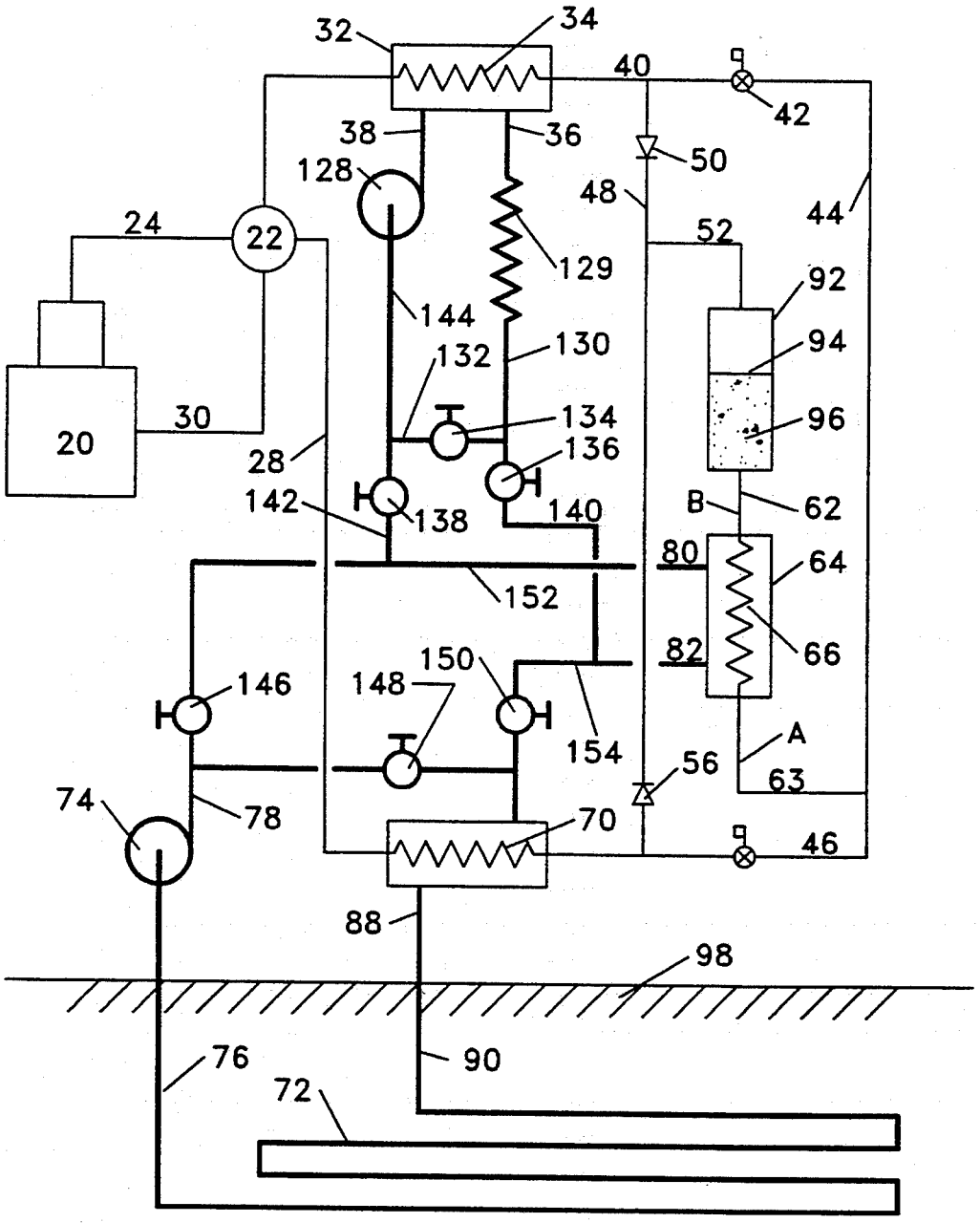
FIG. 3 is a schematic representation of an alternate embodiment of a heat pump system of the present invention employing liquid as the external heat transfer medium.

Referring now to FIG. 3, these is shown a reversible refrigeration system substantially identical with the embodiment of FIG. 1. However, in FIG. 3 the process side brine circuit and the service side brine circuit are interconnected by pipes and service valves which allow sub-cooling heat exchanger 66 to be connected either in the brine inlet stream of the process side heat exchanger 34 or in the brine inlet stream of the service side heat exchanger 70. In the first case, where it is intended to have the sub-cooling heat exchanger 66 connected in the brine inlet stream to process side heat exchanger 34, valves 146, 150 and 134 would be closed and valves 148, 136 and 138 would be opened. In the second case where it is desired to have the subcooling heat exchanger 66 in the brine inlet stream to the service side heat exchanger 70, valves 148, 136 and 138 will be closed and valves 146, 150 and 134 will be opened. With this valving arrangement an operator or engineer will be able to decide in which flow stream she wished the sub-cooling heat exchanger 66 to be positioned For her best system performance.

Referring again to FIG. 1, in an alternate embodiment of the present invention, there is shown air to brine heat exchanger 79 positioned in the brine discharge stream 78 from brine pump 74. Motor driven fan 83 provides a forced airstream over heat exchanger 79. While ground 98 normally provides more than sufficient heat to warm the brine flowing in ground coil 72 and thereby provide sufficient heat to service heat exchanger 70, under end-of-winter conditions the ground 98 has been markedly cooled by the heat abstracting effects of the heat pump in performing its function. Under these conditions the brine leaving the ground 98 to be further cooled by service heat exchanger 70, may have an exit temperature in brine conduit 76 and 78 of lower than 30° F. Therefore, it is likely that the system will be called on to provide heat when the outside ambient temperature of the air is significantly higher than the brine temperature leaving the ground. When these conditions arise, fan 83 is operated to warm the brine flowing through conduit 78 by exposing it to heat exchange with the warmer air forced over it by fan 83. In a further embodiment of the invention, the air-brine heat exchanger 79 is positioned in a space which is exposed to and warmed by sun-effect. An example of such a space is an attic or a green-house. Location of heat exchanger 79 is such a sun-warmed space provides significantly higher brine temperatures entering service heat exchanger 70, thereby establishing substantially higher operating efficiencies by virtue of the higher brine temperatures available to service heat exchanger 70. To achieve the desired brine warming effect, the temperature of air is measured at position D adjacent fan 83 and the temperature of brine is measured flowing in conduit 76 or 78. Whenever the temperature of the air at D is higher than the temperature of brine flowing in conduit 76 or 78, fan 83 is caused to operate, thereby warming the brine enroute to sub-cooler 66.

In a further embodiment of the present invention the sub-cooling heat exchanger 67 of FIG. 2 is positioned in an air stream and provided with dampers which allow the sub-cooling heat exchanger to be positioned in the entering air stream of either the first or the second main heat exchangers.

From the foregoing description, it can be seen that the present invention comprises an improved reversible refrigeration system including novel means for providing increased liquid refrigerant sub-cooling and improved evaporator performance. It will be appreciated by those skilled in the art that changes could be made to the above described embodiments without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A reversible compression type refrigeration system having a first (heating) mode and a second (cooling) mode, a first fluid stream having thermal communication with a heat source/sink, and a second fluid stream, said system comprising first main (service) heat exchanger means having a fluid stream inlet and fluid stream outlet, said first main heat exchanger providing means for evaporating refrigerant and for absorbing heat from the first fluid stream during the first (heating) mode and for condensing refrigerant and for rejecting heat to the first fluid stream during the second (cooling) mode, second main (process) heat exchanger means for evaporating refrigerant and for absorbing heat from the second fluid stream during the second (cooling) mode and for condensing refrigerant and for rejecting heat to the second fluid stream during the first (heating) mode; a compressor having a suction connection and a discharge connection; valve means for connecting the compressor suction connection to the second main (process) heat exchanger and the compressor discharge connection to the first main (service) heat exchanger during the cooling mode and for connecting the compressor discharge connection to the second main (process) heat exchanger and the compressor suction connection to the first main (service) heat exchanger during the heating mode; receiver means for receiving liquid refrigerant from the first main (service) heat exchanger during the cooling mode and from the second main (process) heat exchanger during the heating mode; an expansion device; liquid refrigerant conduit means for conveying liquid refrigerant from the receiver means to the expansion device, and a first sub-cooling heat exchanger positioned in the liquid refrigerant conduit means and subject to the fluid stream entering the first main heat exchanger.

2. A reversible refrigeration as recited in claim 1 where the sub-cooling heat exchanger is positioned in the liquid refrigerant conduit means and subject to the fluid stream entering the first main heat exchanger.

3. A reversible refrigeration as recited in claim 1 where the first fluid stream is air and further including means for establishing an airflow over the first subcooling heat exchanger.

4. A reversible refrigeration system as recited in claim 1 further providing means for subjecting the sub-cooling heat exchanger to the fluid stream entering the first main heat exchanger at one time and for subjecting the sub-cooling heat exchanger to the fluid stream entering the second main heat exchanger at another time.

5. A reversible refrigeration system as recited in claim 4, where the means for subjecting the sub-cooling heat exchanger alternately to the fluid entering the first or the second main heat exchangers are valves.

6. A reversible heat exchanger as recited in claim 2 where the first fluid stream is a liquid and further providing an air to liquid heat exchanger positioned in and subject to the liquid stream flowing to the sub-cooling heat exchanger, means for sensing the temperature of the liquid stream, means for sensing air temperature, and fan means for establishing an air stream in heat exchange relation with said air to liquid heat exchanger whenever the air temperature exceeds the liquid temperature.

* * * * *